United States Patent [19]

Sutker

[11] 3,953,484

[45] Apr. 27, 1976

[54] METHOD OF SEPARATING FATTY ACID FRACTIONS

[76] Inventor: Leonard L. Sutker, 912 Fernhill, Glenside, Pa. 19038

[22] Filed: Aug. 14, 1974

[21] Appl. No.: 496,870

[52] U.S. Cl. ..... 260/419; 260/428

[51] Int. Cl.[2] ..... C11C 1/08

[58] Field of Search ..... 260/419, 428, 413

[56] References Cited

UNITED STATES PATENTS

| | | | |
|---|---|---|---|
| 1,381,705 | 6/1921 | Hapgood | 260/428 |
| 2,200,982 | 5/1940 | Dedlow | 260/428 |
| 2,421,157 | 5/1947 | Myers et al. | 260/419 |
| 2,725,338 | 11/1955 | Perry | 260/428 |
| 3,145,223 | 8/1964 | Little | 260/428 |
| 3,278,413 | 10/1966 | Sparks | 208/33 |

FOREIGN PATENTS OR APPLICATIONS

| | | | |
|---|---|---|---|
| 737,967 | 7/1966 | Canada | 260/428 |

*Primary Examiner*—Winston A. Douglas
*Assistant Examiner*—P. E. Konopka
*Attorney, Agent, or Firm*—Dressler, Goldsmith, Clement & Gordon, Ltd.

[57] ABSTRACT

Fractionation of liquid or solid mixtures of fatty acids is enhanced by a pretreatment which comprises whipping and maceration of the mixture to form a gas-entrained slurry. Preferably the whipping and maceration are carried out in the presence of air. During the pretreatment normally solid fatty acid mixtures are slurrified and the obtained slurry is filterable to separate liquid and solid fatty acid fractions therefrom.

12 Claims, No Drawings

METHOD OF SEPARATING FATTY ACID FRACTIONS

This invention relates to an improved method of separating mixtures of fatty acids into fractions which are respectively relatively rich in solid fatty acids and relatively rich in liquid fatty acids.

There are a number of prior art processes for separating mixed higher fatty acids into "solid acids" and "liquid acids." As used hereinafter, and unless otherwise noted, the term "solid" acids refers generally to saturated acids, such as those typically consisting primarily of stearic and palmitic acids, and the term "liquid" acids refers generally to a mixture which may typically consist chiefly of oleic and linoleic acids, but which might contain other unsaturated acids as well.

The mixed higher fatty acids to be separated into liquid and solid acids are most frequently produced from crude fatty materials, such as from tallows and greases from animal or vegetable sources, and which have been hydrolyzed into fatty acid and glycerine portions and then separated. The fatty acid portion is frequently first distilled to remove impurities following which the remaining fatty acid mixture is ready to be separated into its higher and lower melting constituents.

In accordance with one of the oldest commercial fatty acid separation processes, the "cold press" process, a melted mixture of fatty acids is poured into shallow pans and is then cooled in a refrigerated room until the mixture solidifies. The solidified mixture is then removed from the cooling pans, is wrapped in canvas cloth, and is subjected to hydraulic pressure whereby a large part of the liquid acid fraction, chiefly oleic acid, is pressed out. The liquid acid fraction is commonly referred to as "red oil".

The solid cake or fraction remaining in the canvas wrapping consists chiefly of solid fatty acids, but still retains substantial quantities of liquid fatty acids requiring yet a further separation step. Accordingly, the cake is then removed from its canvas wrapping, is remelted, is poured back into suitable pans, and is cooled again to room temperature. The newly formed cake is then removed from its pan, is wrapped in a hair or nylon mat and is again hydraulically pressed, this time at a much higher temperature. At this higher pressing temperature, which is usually above about 100°F., most of the liquid fatty acid is pressed out, together, however, with some of the solid acid. The expressed fatty acid may be recycled with additional raw material through a cold press step in which the solid acids are recovered, or the expressed fraction may instead be sold as so-called "hot bag stock." The residual cake remaining after the second or "hot press" operation is then remelted, is acid washed and bleached, and is then sold as "stearic acid."

The above method of separating mixed higher fatty acids into their solid and liquid fractions known as "stearic acid" and "red oil" is the oldest commercial method currently in use and is still used despite its many inherent disadvantages, which include the facts that it is quite time consuming and expensive, that it consumes relatively large quantities of energy to practice, and that it requires repeated recycling of the fatty acid materials to be separated.

A more recently developed process for separating mixed higher fatty acids into their solid and liquid components utilizes solvents. In one solvent process, hot distilled mixed fatty acids are dissolved in 90° denatured aqueous methyl alcohol (or in other known polar solvents which are miscible with water), and the resulting solution is cooled slowly until the solid fatty acids precipitate in the form of large filterable crystals. The solid fatty acids are separated, as by filtration, and the solvent retained by the separated solid fatty acids is then removed as by evaporation, leaving behind a solid acid fraction. The filtrate is flash distilled to evaporate the solvent leaving the liquid fraction as a residue. The success of this process depends upon the formation of large filterable crystals in the solution of mixed fatty acids, which requires prolonged, slow cooling. In order to improve the character of the crystals, crystal promoters, such as neutral fats, have been used to provide foci on which the solid fatty acid crystals form during the slow cooling of the solution of the mixed higher fatty acids. Obviously, this process is also expensive and time consuming and requires specialized equipment, solvents and solvent recovery systems.

Another process for separating mixtures of fatty acids from either animal or vegetable origin depends on heating the mixture of fatty acids to a temperature above the melting point of the mixture and rapidly chilling within a few minutes, typically within about 5 minutes, to a temperature which is below the melting point of the fatty acid mixture, but which is above the melting point of the lowest melting fatty acid constituents. The supercooled mixture is then mixed with a solvent for the fatty acids at a controlled low temperature so that a higher melting consitutent fatty acid fraction (a solid acid fraction) is insoluble or only sparingly soluble in the solvent. The higher melting fatty acid (solid) fraction is then separated from the solution of the lower melting fatty acid fraction, as by filtration, centrifuging or otherwise. The solid acids so separated then go to a stripping still where the retained solvent is removed, leaving behind solid fatty acids, such as stearic acid. The filtrate also goes to a stripping still to drive off solvent leaving a liquid acid fraction such as "red oil." Here again, the practice of this process is expensive and requires the use of specialized equipment, solvents and solvent recovery system.

These are typical of processes which have been used for years to separate solid and liquid fatty acid. Although when the mixed fatty acids used are tallow fatty acids, each process typically produces stearic acid and red oil fatty acid fractions which are acceptable and widely used commercially, each, in terms of processing techniques and costs has its very substantial drawbacks.

In accordance with the present invention, many of the drawbacks of the prior art fatty acid separation processes are eliminated and a process is made available which permits rapid and efficient separation of fatty acid fractions at lower overall cost and in a simpler fashion than prior art separation techniques permit.

The method of this invention efficiently and effectively serves to separate fatty acids into fractions having a relatively greater proportion of high melting point constituents, a solid fraction, and a relatively greater proportion of low melting point constituents, a liquid fraction, and comprises the steps of providing a mixture of fatty acids so to be separated, of vigorously whipping or macerating the mixture, preferably in the presence of air to incorporate air into the mixture, for a time adequate to produce a gas-entrained pourable or pumpable slurry, and then of filtering the slurry under the influence of pressure different from ambient pressure to produce a filtrate (a liquid fraction) having a relatively greater proportion of lower melting constituents and a solid fraction having a relatively greater proportion of higher melting constituents. The filtering may be by vacuum drawn through the downstream side of a filter or may be superatmospheric pressure exerted on the slurry on the upstream side of the filter.

As will be explained, the fatty acid mixture to be separated, prior to whipping or macerating, may be liquid or solid. Curiously, the process of this invention has been found to operate effectively using cakes or other solidified fatty acid mixtures which are normally solid and non-flowable at the temperatures at which they are whipped. However, after whipping, at a temperature at which the solid acids normally remain solid and non-flowable, the whipped mixture becomes a fluidized, readily pourable, pumpable slurry which is easily and effectively filtered into solid and liquid fractions under the influence of pressure. As such, the necessity of heating or otherwise treating the fatty acid mixture to be separated prior to filtering is eliminated. The fractions produced, at a much lower cost and with a minimum of processing, are of a quality comparable to those obtained at much greater cost and only after much more complex processing.

As such, the process of this invention provides very meaningful and significant savings in cost and equipment.

In accordance with a preferred embodiment of this invention, mixed fatty acids to be separated are cooled down artifically to a point at which the acids are generally solid. Cooling may take place in a variety of ways, for example in pans in refrigerated rooms as is currently the vogue with cold press processes. Alternatively, the cooling may take place on a continuous basis, as on the chilled surface of a roll or conveyor, from which the solids are scraped, as by a doctor blade, or in a heat exchanger, such as a chilling tank.

The solid mixture of fatty acids is then introduced into a vessel or container in which the mixture is whipped or macerated and in which, at substantially the same temperature, it changes from its solid non-flowable, non-pumpable consistence into a fluidized, flowable, pumpable slurry which is in condition to be conveyed, as by pumping, to a vacuum or pressure filter. Such filters may be conventional filters. Filtration yields relatively rich solid and liquid fractions, typically liquid fractions having melting points of from about 0° to about 30°C. and solid fractions having melting points of from about 48°C. to about 52°C. when made from tallow fatty acids.

As will be pointed out, it is also possible to whip, macerate or churn mixtures of fatty acid which are in a liquid and limpid condition and then to filter such a mixture and to achieve meaningful and effective separation.

I do not understand exactly why the whipping and macerating of fatty acid mixtures which are non-pumpable and non-filterable at a given temperature promotes their effective separation into liquid and solid fractions, at substantially the same temperature, but it does. It is clear, however, that the mixture becomes fluidized and, indeed, I have found in some cases that the fluidized mixture upon standing actually shows some liquid separation.

It appears to me that some air is incorporated into the whipped mixture. Although I cannot be certain, it is possible that the entrained air may tend to surround solid particles, thereby tending to isolate the liquid acid constitutents making conventional filtration of the aerated mixture possible.

Regardless of the mechanism, the fact is that separation is more easily and much less expensively achieved than with processes conventionally used on a widespread basis.

I shall now describe typical methods by which I have found my invention may be practiced.

EXAMPLE I

A mixture of melted tallow fatty acids was placed in a pan and was allowed to cool down to about 25°C., at which point the mixture was solid.

Portions of the solid cake at about 25°C. were removed from the pan and were examined and found to be solid, non-pourable and non-flowable. The portions which had been removed and examined were then placed in a blender and were whipped vigorously for approximately a minute to incorporate air.

The temperature of the whipped mixture remained at about 25°C. However, its consistency changed from a solid, non-flowable state to a fluidized, pourable, readily pumpable slurry. This slurry was then introduced into a filter, and vacuum was applied downstream of the filter to draw a filtrate through the filter, leaving a filter cake on the filter.

The whipped slurry produced a liquid fraction of about 64% having a titer of 23°C. and a solid fraction of about 36% having a titer of 50°C. Titer may be determined in accordance with standard tests set forth in the Official and Tentative Methods of the American Oil Chemists Society, Test L60-55.

EXAMPLE II

A mixture of tallow fatty acids was brought to a temperature at which it was liquid and limpid. The mixture was then deposited on a chilled surface upon which a thin solid layer of fatty acids was formed. The chilled fatty acids at a temperature of about 25°C. were scraped from the chilled surface and were found to be solid, non-pourable and non-pumpable at that temperature.

The solid fatty acids were then whipped in the presence of air and separated in the manner described in Example I, with substantially the same results.

EXAMPLE III

A mixture of tallow fatty acids was brought to a temperature at which all of the components were liquid and limpid. The mixture was then rapidly cooled down, with mixing and stirring, to a temperature of about 35°C. At this temperature, the mixture was still essentially liquid.

That mixture was then placed in a blender and was whipped vigorously to incorporate air for about a minute. Following whipping the mixture was a pourable and pumpable slurry which remained at about 35°C.

The mixture was then vacuum filtered to yield a filtrate of about 65% having a titer about 32°C. and a solid fraction of about 35% having a titer of about 50°C.

EXAMPLE IV

The lower titer fraction of Example III was heated to a temperature at which all of the components were liquid and limpid. It was then rapidly cooled down to 10°C. That fraction was then whipped vigorously to incorporate air for about a minute, after which the slurry was vacuum filtered to yield a liquid fraction of about 55% having a titer of 8°C. and a solid fraction of about 45% having a titer of about 42°C.

EXAMPLE V

A mixture of cottonseed fatty acids having a titer of about 34°C. was heated to a temperature of about 50°C., at which the mixture was clear and limpid. The mixture was then cooled by placing it in a pan at 5°C. in which it was allowed to stand for about 1 hour.

The solidified mixture, the cake, was then removed and was placed in a blender in which it was whipped in the presence of air for about a minute as a result of which it became a fluidized, pourable, pumpable slurry. The slurry was then poured into a vacuum filter and was filtered to produce a liquid fraction having a titer of 12°C. and a yield of about 35% and a solid fraction having a titer of 48°C. and a yield of about 65%.

EXAMPLE VI

A mixture of soya fatty acids having a titer of about 23°C. was heated to a temperature of about 50°C., at which the mixture was clear and limpid. The mixture was then cooled by placing it in a vessel positioned in a water bath at 10°C. The mixture was cooled with stirring and scraping to about 12°C.

The solidified mixture was then removed from the beaker and was placed in a blender in which it was whipped and macerated in the presence of air for about a minute as a result of which it became a liquified, pourable, pumpable slurry incorporating some air. The slurry was then poured into a vacuum filter and was filtered to produce a liquid fraction having a titer of 13°C. and a yield of about 62% and a solid fraction having a titer of 39°C. and a yield of about 38%.

EXAMPLE VII

A mixture of coconut fatty acids having a titer of about 24°C. was heated to a temperature of about 40°C., at which the mixture was clear and limpid. The mixture was then cooled to about 15°C. by pouring it onto a chilled cylindrical surface. The solid material was then scraped from the surface and was placed in a blender in which it was whipped and macerated for about a minute as a result of which it became a liquified, pourable, pumpable slurry. The slurry was then poured into a vacuum filter and was filtered to produce a liquid fraction having a titer of 22°C. and a yield of about 59% and a solid fraction having a titer of 28°C. and a yield of about 41%.

EXAMPLE VIII

A mixture of tallow fatty acids having a titer of about 40°C. was heated to a temperature of about 60°C. at which point the mixture was clear and limpid. The mixture was then cooled by pouring it into a pan and allowing it to stand for about 2 hours at about 20°C.

The solidified mixture was then placed in a blender and was macerated and whipped for about one minute. The mixture became a fluidized or liquified slurry which was pourable. It was poured into a vacuum filter and filtered to produce a liquid fraction having a titer of 20°C. and a yield of about 47% and a solid fraction having a titer of 50°C. and a yield of about 53%.

EXAMPLE IX

A mixture of tallow fatty acids having a titer of about 40°C. was heated to a temperature of about 60°C. at which point the mixture was clear and limpid. The mixture was then cooled by placing it in a vessel submersed in a chilled bath maintained at 15°C. The mixture was chilled with scraping and stirring to 20°C.

The solidified mixture was then placed in a blender and macerated and whipped in the presence of air for about 1 minute. The mixture became a fluidized or liquified slurry which was pourable. It was poured into a vacuum filter and produced a solid fraction having a yield of about 55% and a titer of 49°C. and a liquid fraction having a titer of 20°C. and a yield of about 45%.

EXAMPLE X

A mixture of tallow fatty acids having a titer of about 40°C. was heated to a temperature of about 60°C. at which point the mixture was clear and limpid. The mixture was then cooled by pouring it over a chilled cylindrical surface cooled to about 15°C. The material was allowed to set up and was then scraped off and placed in a blender and macerated and whipped in the presence of air for about 1 minute. The mixture became a fluidized, pumpable slurry which was pourable. It was poured into a vacuum filter and produced a solid fraction having a yield of 55% and a titer of 48°C. and a liquid fraction having a titer of 20°C. and a yield of 45%.

In each of the examples, it is clear that an efficient and effective separation by a simple filtration procedure was promoted by vigorously whipping and macerating a fatty acid mixture for a time adequate to produce a fluidized slurry. In the examples, small quantities were readily so converted in less than about a minute. The time adequate will depend upon the equipment available, the quantities to be whipped and macerated and the initial temperature of the mixture, as will be apparent from the foregoing description and examples. In each case it appeared that separation was also promoted by whipping in the presence of air as a result of which some air was incorporated in the slurry.

It is also clear that the whipping step made effective separation possible simply by mechanical processing, where mechanical processing previously has been possible only when the expensive and time consuming "cold press" method referred to above has been used.

In Examples 4–10 the temperature of the slurry was substantially the same as that of the mixture prior to whipping, but in any event was a temperature at which the mixture would normally be solid. In all of the examples, the percentages given are weight, not volume, percentages.

Although the examples have specifically described the separation of certain types of fatty acids, it is contemplated that it will be equally applicable to the separation of other higher fatty acids as well. In addition to the mixed acids referred to, other fatty acids from vegetable oils, such as corn oil and palm oil, may be used, other animal mixtures, such as those derived from White Grease, Brown Grease, garbage grease and from fish oils, such as Menhaden Oil, may also be used, and mixtures derived even from synthetic sources may be used. Of course, the mixed fatty acids to be separated in accordance with this invention may have had prior treatment, such as hydrogenation, or other well-known treatments to remove various impurities. The process of this invention however, is effective to separate mixed fatty acids whether or not they have been distilled initially to remove impurities or otherwise treated.

While I have described presently preferred embodiments and examples of the manner in which my invention may be practiced, my invention is not so limited, as will be appreciated by those skilled in the art. Accordingly, I intend to be limited only insofar as may be made necessary by the appended claims.

What is claimed is:

1. A method of separating mixed fatty acids into fractions having a relatively greater proportion of high melting point constituents and a relatively greater proportion of low melting point constituents comprising the steps of providing a mixture of fatty acids to be separated into fractions, vigorously whipping the said mixture and continuing the whipping for a period adequate to produce a liquified, pumpable, gas-entrained slurry, then filtering said slurry under the influence of pressure different from ambient pressure to produce a filtrate having a relatively greater proportion of low melting constituents and a solid fraction having a relatively greater proportion of high melting constituents.

2. The method of claim 1 in which said mixture of fatty acids to be separated is cooled prior to whipping to produce a solid mixture and which yields a pumpable slurry after whipping at a temperature at which the mixture is usually solid.

3. The method of claim 2 in which said different pressure is a vacuum.

4. The method of claim 2 in which said different pressure is superatmospheric.

5. The method of claim 1 in which said mixture of fatty acids is a mixture of tallow fatty acids and the filtrate is red oil and the solid fraction is commercial grade stearic acid.

6. The method of claim 5 in which said mixture of fatty acids to be separated is solid prior to whipping and yields a pumpable slurry after whipping at a temperature at which the mixture is usually solid and in which said whipping continues for at least about 1 minute.

7. The method of claim 1 in which said whipping takes place in the presence of air to incorporate air into the mixture whereby the slurry produced is an aerated slurry.

8. The method of claim 2 in which said whipping takes place in the presence of air to incorporate air into the mixture whereby the slurry produced is an aerated slurry, and said whipping continues for at least about 1 minute.

9. The method of claim 8 in which said mixture of fatty acids is a mixture of tallow fatty acids and the filtrate produced is red oil an the solid fraction produced is commercial stearic acid.

10. A method of separating a liquid mixture of fatty acids into a fraction having a relatively greater proportion of higher melting point constituents and a fraction having a relatively greater proportion of lower melting point constituents which comprises the steps of chilling said liquid mixture so as to solidify the mixture, whipping the solidified mixture to produce a gas-entrained, liquified slurry, and filtering the liquified slurry under pressure different from ambient pressure so as to separate the liquified slurrry into a filtrate having a relatively greater proportion of lower melting constituents and a solid fraction having a relatively greater proportion of higher melting constituents.

11. A method in accordance with claim 10 in which said whipping takes place in the presence of air to produce an air-entrained, liquified pumpable slurry.

12. A method in accordance with claim 11 in which said solidified mixture is a mixture of tallow fatty acids and the filtrate produced is red oil and the solid fraction produced is commercial stearic acid.

* * * * *